US009695560B2

(12) United States Patent
Neusch

(10) Patent No.: US 9,695,560 B2
(45) Date of Patent: Jul. 4, 2017

(54) PORTABLE NET BARRIER SYSTEM

(71) Applicant: Stephen Neusch, Austin, TX (US)

(72) Inventor: Stephen Neusch, Austin, TX (US)

(73) Assignee: Stephen Neusch, Austin, TX (US)

( * ) Notice: Subject to any disclaimer, the term of this patent is extended or adjusted under 35 U.S.C. 154(b) by 0 days.

(21) Appl. No.: 14/832,696

(22) Filed: Aug. 21, 2015

(65) Prior Publication Data

US 2016/0053450 A1 Feb. 25, 2016

Related U.S. Application Data

(60) Provisional application No. 62/040,971, filed on Aug. 22, 2014.

(51) Int. Cl.

| | |
|---|---|
| ***E01F 13/00*** | (2006.01) |
| ***E01F 13/02*** | (2006.01) |
| ***E01F 13/12*** | (2006.01) |

(52) U.S. Cl.

CPC ..... *E01F 13/028* (2013.01); *E01F 13/123* (2013.01)

(58) Field of Classification Search

CPC ..... E01F 13/04; E01F 13/024; E01F 13/028; E01F 13/148; E01F 13/146

USPC ..... 49/9; 404/6

See application file for complete search history.

(56) References Cited

U.S. PATENT DOCUMENTS

| | | | | |
|---|---|---|---|---|
| 1,545,053 | A * | 7/1925 | Kelly | 49/9 |
| 3,827,660 | A * | 8/1974 | Doolittle | 244/110 C |
| 4,456,205 | A * | 6/1984 | Alavoine et al. | 244/110 C |
| 5,118,056 | A * | 6/1992 | Jeanise | 246/127 |
| 5,762,443 | A * | 6/1998 | Gelfand et al. | 404/6 |
| 5,823,705 | A * | 10/1998 | Jackson et al. | 404/6 |
| 6,843,613 | B2 * | 1/2005 | Gelfand et al. | 404/6 |
| 7,210,873 | B2 * | 5/2007 | Gelfand | 404/6 |
| 7,374,362 | B1 * | 5/2008 | Metzger | 404/6 |
| 7,785,031 | B2 * | 8/2010 | Vellozzi et al. | 404/6 |
| 7,950,870 | B1 * | 5/2011 | Thompson et al. | 404/6 |
| 8,240,947 | B2 * | 8/2012 | Gelfand et al. | 404/6 |
| 2007/0258761 | A1 * | 11/2007 | Orner et al. | 404/6 |

FOREIGN PATENT DOCUMENTS

| | | | | |
|---|---|---|---|---|
| EP | 2942435 | A1 * | 11/2015 | |
| WO | WO 9002229 | A1 * | 3/1990 | E01F 13/00 |

* cited by examiner

*Primary Examiner* — Jerry Redman

(74) *Attorney, Agent, or Firm* — Conley Rose, P.C.

(57) ABSTRACT

A barrier system including an elastic net coupled to a cable, an energy absorption member coupled between the cable and an anchoring assembly, and an actuation assembly coupled to the net and configured to rotate the net about an axis of rotation between a closed position restricting vehicle access through the barrier system, and an open position allowing vehicle access through the barrier system.

18 Claims, 16 Drawing Sheets

PORTABLE NET BARRIER SYSTEM

CROSS-REFERENCE TO RELATED APPLICATIONS

This application claims benefit of U.S. provisional patent application Ser. No. 62/040,971 filed Aug. 22, 2014, and entitled "Portable Net Barrier System," which is hereby incorporated herein by reference in its entirety.

STATEMENT REGARDING FEDERALLY SPONSORED RESEARCH OR DEVELOPMENT

Not applicable.

BACKGROUND

Vehicle barriers are sometimes used to provide access point control by denying unauthorized access to roadways, facilities, and other resources. For instance, vehicle barriers may be used to control access at entrances and exits of facilities and roadways, and to restrict vehicle access to unauthorized areas, such as areas reserved for pedestrian traffic. Vehicle barriers take many forms, including net barriers, cable barriers, wedge barriers, plate barriers, gates, bollards, and others.

Vehicle barriers may be either passive or active in nature. Specifically, passive vehicle barriers are fixed in a closed position where access is continuously denied and active vehicle barriers are configured for selectable actuation between an open position where vehicular access is allowed and a closed position denying vehicular access. Further, vehicle barriers may also be either permanent or portable. Permanent vehicle barriers are typically permanently affixed to the ground where they are installed, such as through cementing the barrier into position. On the other hand, portable barriers are typically not permanently coupled to the ground, and thus may be transported and installed in various locations.

Currently, portable vehicle barriers may suffer from several problems. Specifically, portable vehicle barriers are typically cumbersome to transport, install, and actuate between open and closed positions. For instance, portable vehicle barriers often require relatively high amounts of power to operate, are slow to deploy and retract between open and closed positions, and do not provide adequate protection to the barrier from wear caused by vehicular traffic across or over the barrier when in the open position. Also, these portable barriers may only provide hard impact to a vehicle colliding with it, thus increasing the amount of damage to both the intercepted vehicle and the barrier, as well as increasing the probability and severity of injury to occupants of the intercepted vehicle.

BRIEF SUMMARY OF THE DISCLOSURE

An embodiment of a barrier system comprises an elastic net having a cable coupled thereto, and an energy absorption member coupled between the cable and an anchoring assembly, wherein the cable is configured to transfer a kinetic energy of a moving vehicle impacting the net to the energy absorption member, wherein the energy absorption member is configured to absorb at least a portion of the kinetic energy. In an embodiment, the anchoring assembly is configured to releasably affix the barrier system to the ground. In an embodiment, the energy absorption member comprises a bungee cord. In some embodiments, the barrier system further comprises a link assembly coupled to the net and configured to displace the net vertically with respect to the ground between a closed position restricting vehicle access through the barrier system, and an open position allowing vehicle access through the barrier system. In some embodiments, the barrier system further comprises an actuation assembly configured to actuate the barrier system between the closed and open positions. In an embodiment, the actuation assembly comprises a motor configured to drive a sprocket coupled to the link assembly. In an embodiment, the anchoring assembly comprises a plate releasably coupled to the ground via a plurality of bolts. In some embodiments, the barrier system further comprises an actuation assembly configured to actuate the barrier system between a closed position restricting vehicle access through the barrier system, and an open position allowing vehicle access through the barrier system, and wherein each longitudinal end of the net is coupled to a post configured to be rotated about an axis of rotation in response to the actuation assembly actuating the barrier system between the closed and open positions. In some embodiments, the actuation assembly comprises a motor and a drive shaft coupling the motor to one of the posts, and wherein the drive shaft is disposed coaxially with the axis of rotation.

An embodiment of a barrier system comprises an elastic net coupled to a cable, and an energy absorption member coupled between the cable and an anchoring assembly, wherein the energy absorption member is configured to absorb kinetic energy transmitted to the cable from a moving vehicle impacting the net. In an embodiment, the anchoring assembly is configured to releasably affix the barrier system to the ground. In an embodiment, the energy absorption member comprises a bungee cord. In some embodiments, the barrier system further comprises an actuation assembly configured to actuate the barrier system between a closed position restricting vehicle access through the barrier system, and an open position allowing vehicle access through the barrier system, and wherein each longitudinal end of the net is coupled to a post configured to be rotated about an axis of rotation in response to the actuation assembly actuating the barrier system between the closed and open positions. In some embodiments, the actuation assembly comprises a motor and a drive shaft coupling the motor to one of the posts, and wherein the drive shaft is disposed coaxially with the axis of rotation. In an embodiment, the actuation assembly comprises a motor configured to drive a sprocket coupled to the link assembly. In an embodiment, the anchoring assembly comprises a plate releasably coupled to the ground via a plurality of bolts.

An embodiments of a barrier system comprises an elastic net coupled to a cable, an energy absorption member coupled between the cable and an anchoring assembly, and an actuation assembly coupled to the net and configured to rotate the net about an axis of rotation between a closed position restricting vehicle access through the barrier system, and an open position allowing vehicle access through the barrier system. In an embodiment, the anchoring assembly is configured to releasably affix the portable barrier system to the ground. In an embodiment, each longitudinal end of the net is coupled to a post configured to be rotated about the axis of rotation in response to the actuation assembly actuating the barrier system between the closed and open positions. In some embodiments, one of the posts coupled to a longitudinal end of the net is coupled to the actuation assembly via a drive shaft, and wherein the drive shaft is disposed coaxially with the axis of rotation. In some embodiments, the drive shaft is coupled to a motor of the actuation assembly configured to apply a torque to the drive shaft.

BRIEF DESCRIPTION OF THE DRAWINGS

For a detailed description of exemplary embodiments, reference will now be made to the accompanying drawings in which.

DETAILED DESCRIPTION

Figure 1:
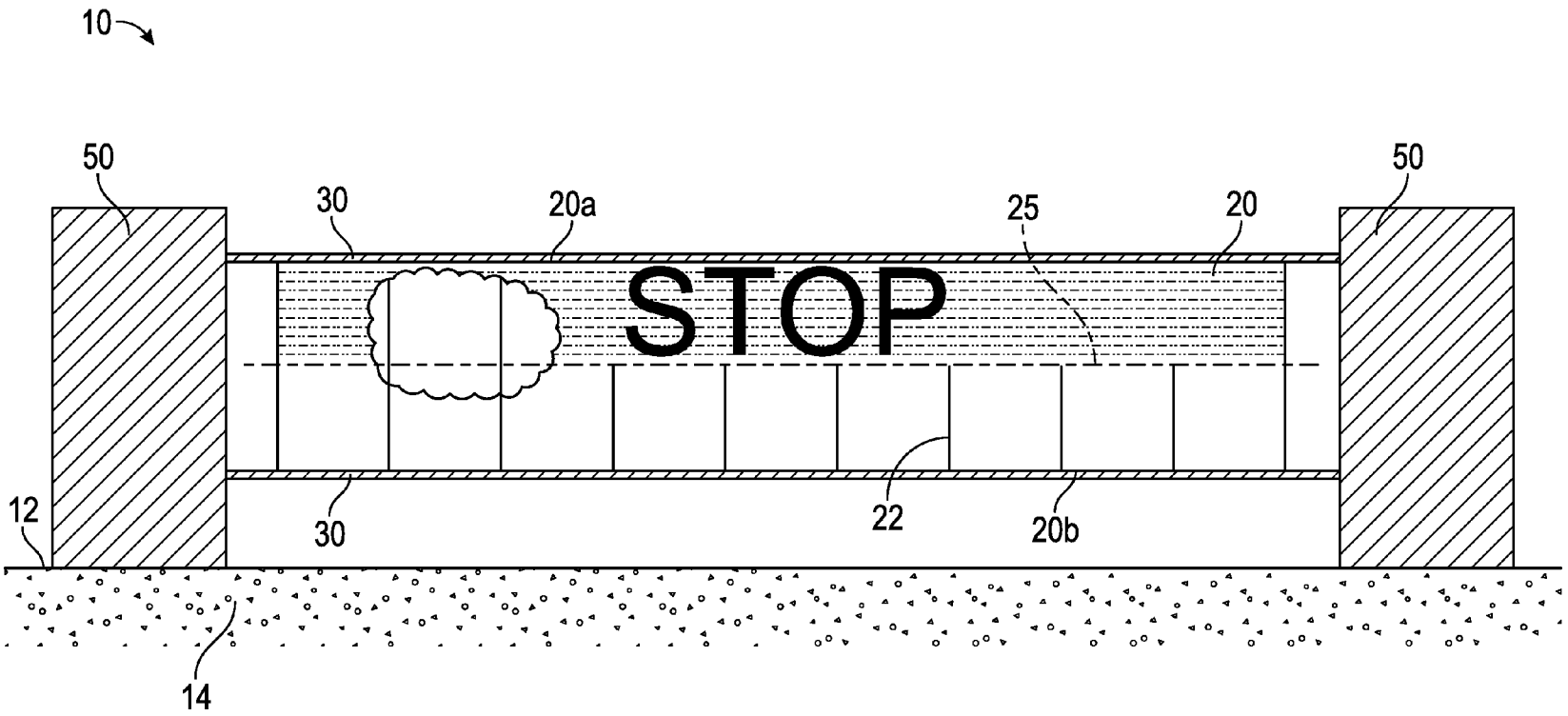
FIG. 1 is a front view of an embodiment of a net barrier system, illustrated in a closed position, in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

The embodiments described herein include a portable barrier system configured to selectably restrict vehicle access at predetermined controlled access points. The portable barrier system is also configured to actuate between an open position permitting vehicle access through the portable barrier, and a closed or restricted position restricting vehicular access therethrough. Specifically, in the closed position, in the event of a vehicle attempting to traverse the access point, the portable barrier system is configured to intercept and decelerate the moving vehicle until the motion of the vehicle has ceased, thereby preventing the vehicle from successfully traversing the controlled access point. The portable barrier may be actuated between the closed and open positions manually or remotely using an electronic controller. The actuation of the portable barrier between the closed and open positions may be powered mechanically, such as through the use of a hand-crank and the like, electrically using an electric motor, or through other mechanisms. Thus, the actuation of the portable barrier requires relatively low power. Further, the portable barrier is configured to retract and deploy between the closed and open positions in a relatively small amount of time.

An embodiment of a portable barrier described herein is generally configured to selectably control vehicular access at a desired location or controlled access point. For instance, the embodiment, when in a closed or restricted position as described above, is configured to intercept or arrest the motion of a vehicle attempting to pass therethrough. More particularly, the embodiment is configured to decelerate to a stop the intercepted vehicle in a manner that does not, or at least mitigates, damage to the portable barrier and/or the intercepted vehicle, and reduces the probability or severity of injury to the intercepted vehicle's occupants.

Specifically, the embodiment of a portable barrier discussed herein is configured to decelerate the intercepted vehicle at an acceleration that does not destroy or severely damage the intercepted vehicle and is not lethal to the vehicle's occupants. The embodiment of a portable barrier system is also configured to be mobile or portable, such that it may be transported and installed at a first controlled access point, operated at the first access point to provide controlled or selectable access thereat, and then uninstalled and transported to a second controlled access point, where it may then be installed and operated to provide controlled access thereat. Further, because the embodiment is configured to intercept and arrest the motion of a moving vehicle without being substantively damaged, in the event of an intercept of a moving vehicle attempting to traverse the controlled access point defined by the portable barrier, the barrier may be subsequently reset following the interception of the vehicle, such that the barrier may be once again operational for selectably controlling vehicular access. Moreover, the portable barrier is configured to perform at the ASTM-M30, ASTM-PU50, ASTM-PU40, and ASTM-PU30 ratings.

An embodiment of a portable net barrier described herein generally includes a net extending between a pair of buttress assemblies coupled or affixed to the ground, where the net is coupled to the buttress assemblies via a pair of cables. The net is configured to intercept and the arrest the motion of a moving vehicle attempting to travel between the pair of buttress assemblies by transferring a resistive or arresting force to the vehicle, thereby decelerating the vehicle and ceasing the vehicle's motion. The net is also configured to transfer and equally distribute between the pair of cables the reactive force imparted to the net from the arrested vehicle, where the pair of cables are configured to transfer the reactive force from the net to one or more energy absorption members disposed within the buttress assemblies. The energy absorption members are in turn configured for absorbing a portion of the energy transferred to the net and cables from the arrested vehicle, and transferring the remaining reactive force to anchor assemblies disposed in the buttress assemblies.

The anchor assemblies anchor and affix the buttress assemblies to the ground and transmit the remaining reactive force from the energy absorption members to the ground. The buttress assemblies, besides housing the energy absorption members and anchor assemblies, are configured to provide for the actuation of the portable barrier system between the open and closed or restricted positions described above. Specifically, the buttress assemblies (deploying from the open position to the closed position) are configured to raise or displace the pair of cables and net coupled thereto vertically from the ground until the net is fully extended to restrict vehicle access between the two buttress assemblies, which thereby define a controlled access point. Also, (retracting from the closed position to the open position) the buttress assemblies are configured to vertically lower the pair of cables and net coupled thereto until the pair of cables are stacked vertically on the ground and the net is folded in half lengthwise along the ground, allowing vehicle access between the buttress assemblies and over the folded net. However, in other embodiments the buttress assemblies may be configured to rotate the net as the portable net barrier actuates between the closed and open positions, with the net lying flat and unfolded along the ground when the portable net barrier is in the open position.

Referring now to FIG. 1, an embodiment of a net barrier system 10 is shown in a closed position restricting vehicle access therethrough and generally includes a net 20, a pair of horizontally extending cables 30, and a pair of buttress assemblies 50 coupled or affixed to the surface 12 of the ground 14. In some embodiments, the barrier system 10 is a portable barrier system. For ease of description, the barrier system 10 may be referred to as a portable barrier system, though it is understood that the barrier system 10 may not be portable in other embodiments. The net 20 is configured to intercept a moving vehicle attempting to travel between the pair of buttress assemblies 50 by transferring an arresting force to the vehicle and thereby decelerate the vehicle, ceasing the vehicle's motion. Net 20 is further configured such that it may intercept a moving vehicle without being itself damaged, allowing net 20 to be reused following an interception of a moving vehicle. Cables 30 are also configured to survive an interception, and thus be reused following the interception of a moving vehicle. In the embodiment shown in FIG. 1, cables 30 comprise 0.75" wire rope; however, in other embodiments, cables 30 may comprise other materials and cross-sectional sizes of sufficient strength to arrest the motion of an intercepted vehicle.

Net 20 has a central or longitudinal axis 25, an upper edge 20*a*, and a lower edge 20*b*. The net 20 couples to the cables 30 along the longitudinal axis 25 at upper and lower edges 20*a* and 20*b*, respectively. In this embodiment, net 20 includes an elastic nylon webbing 22 that extends between the cables 30 and is configured to partially absorb energy transferred to the net 20 from the impact of a moving vehicle. For instance, energy may be absorbed by net 20 through the elastic deformation of nylon webbing 22 during the interception of a moving vehicle. However, in other embodiments net 20 may comprise other elastic or deformable materials and structures configured to transfer loads from the impact of a moving vehicle to cables 30. Also, because net 20 is elastic, it may generally deform to the contour of the vehicle on impact, thereby eliminating, or at least mitigating against, damage to the intercepted vehicle caused by the collision between the vehicle and net 20. Further, the elasticity of net 20 allows for a lower or more gradual rate of deceleration of the intercepted vehicle upon impact, thereby lessening the damage done to the vehicle and mitigating against the possibility of injury or reducing the severity thereof to any of the intercepted vehicle's occupants.

Figure 2:
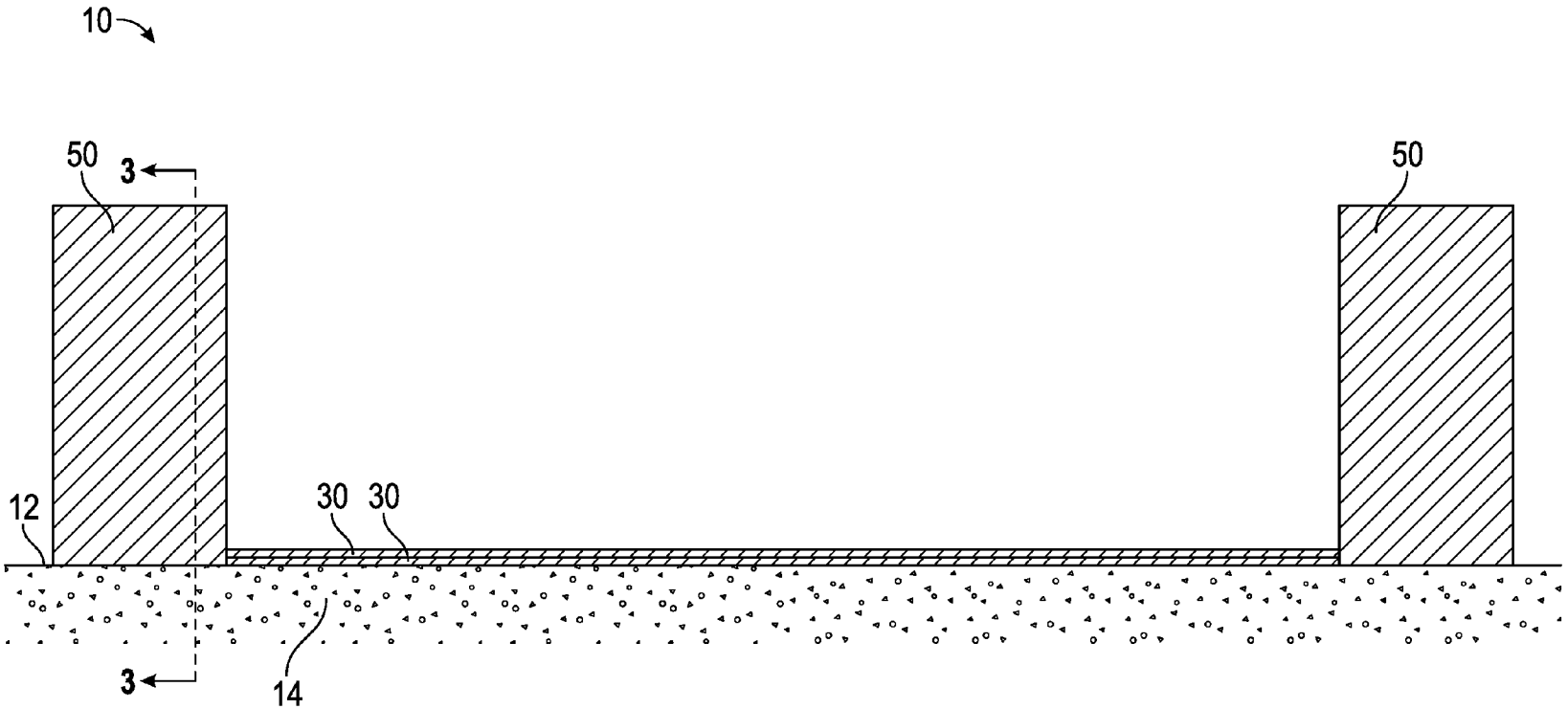
FIG. 2 is a front view of the net barrier system of FIG. 1, illustrated in an open position, in accordance with principles disclosed herein.

Referring to FIG. 2, the portable barrier system 10 is shown in an open position allowing vehicle access between the pair of buttress assemblies 50 of the system 10. In the open position, cables 30 are stacked vertically (orthogonally with respect to longitudinal axis 25 of net 20) on the surface 12 of the ground 14. Although not shown in FIG. 2, in the open position net 20 is folded lengthwise along longitudinal axis 25, thus minimizing the footprint of net 20 on the surface 12. In this arrangement, the amount of wear and tear produced on net 20 from vehicle traffic traversing between buttress assemblies 50 and over folded net 30 is reduced due to the relatively small footprint of the net 20 and cables 30 on the surface 12 provided by the stacked arrangement of cables 30 and the lengthwise folded arrangement of net 20.

Referring now to FIGS. 3-8, each buttress assembly 50 generally includes a hinged link assembly 52, an actuation assembly 70, and an anchoring assembly 90. Buttress assembly 50 is configured to provide for the actuation of the portable barrier system 10 between the closed and open positions shown in FIGS. 1 and 2, respectively. Specifically, buttress assembly 50 is configured to vertically (orthogonally with respect to longitudinal axis 25) raise and lower cables 30 and net 20 between the closed position shown in FIG. 1 and the open position shown in FIG. 2. Further, buttress assembly 50 is configured to transfer the energy and force transmitted to the net 20 from the decelerating vehicle to the ground 14 via cables 30 and anchoring assembly 90.

Figure 3:
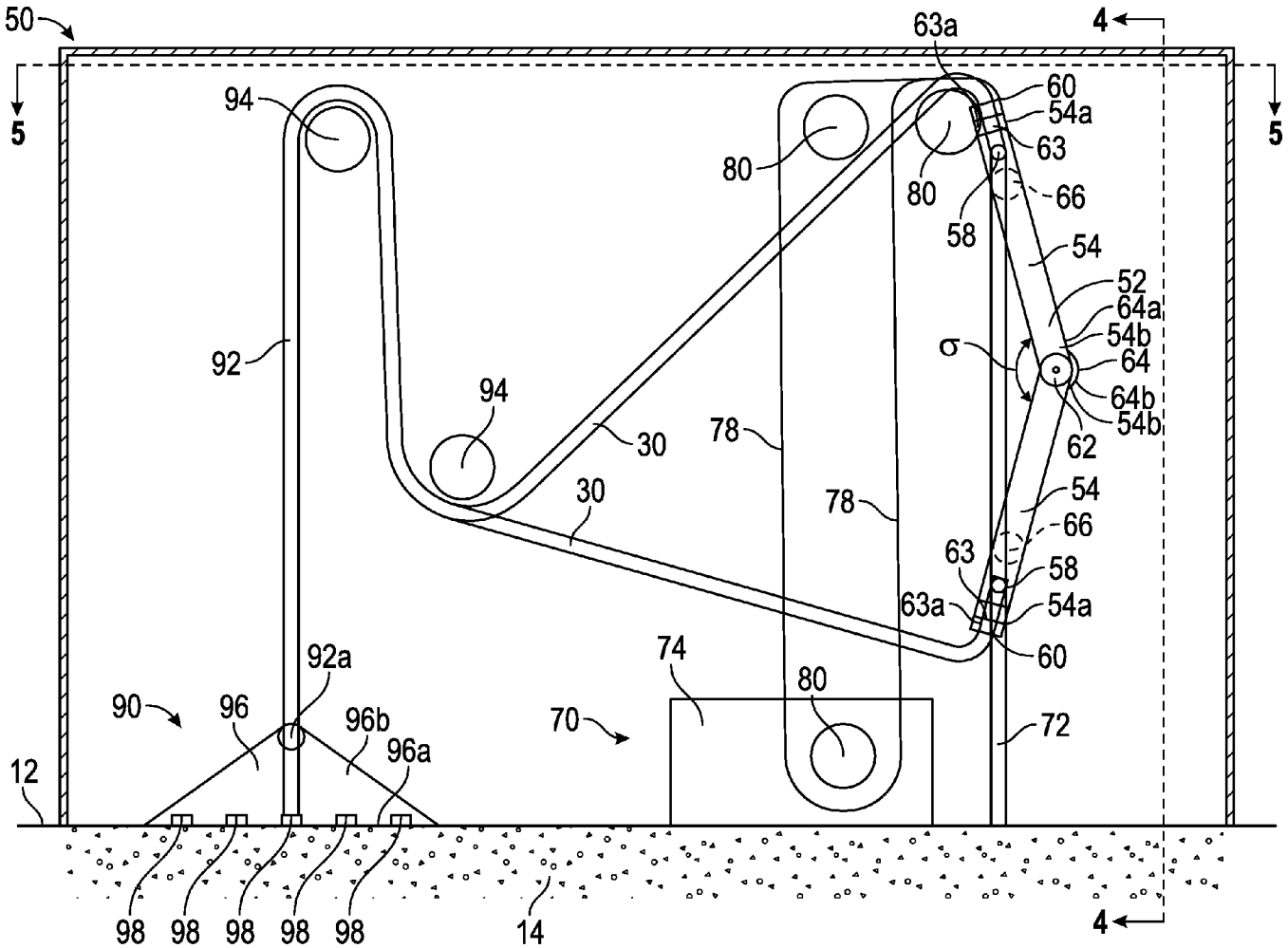
FIG. 3 is a cross-sectional side view along line 3-3 of a buttress assembly of the net barrier system of FIG. 1, illustrated in a closed position, in accordance with principles disclosed herein.
Figure 4:
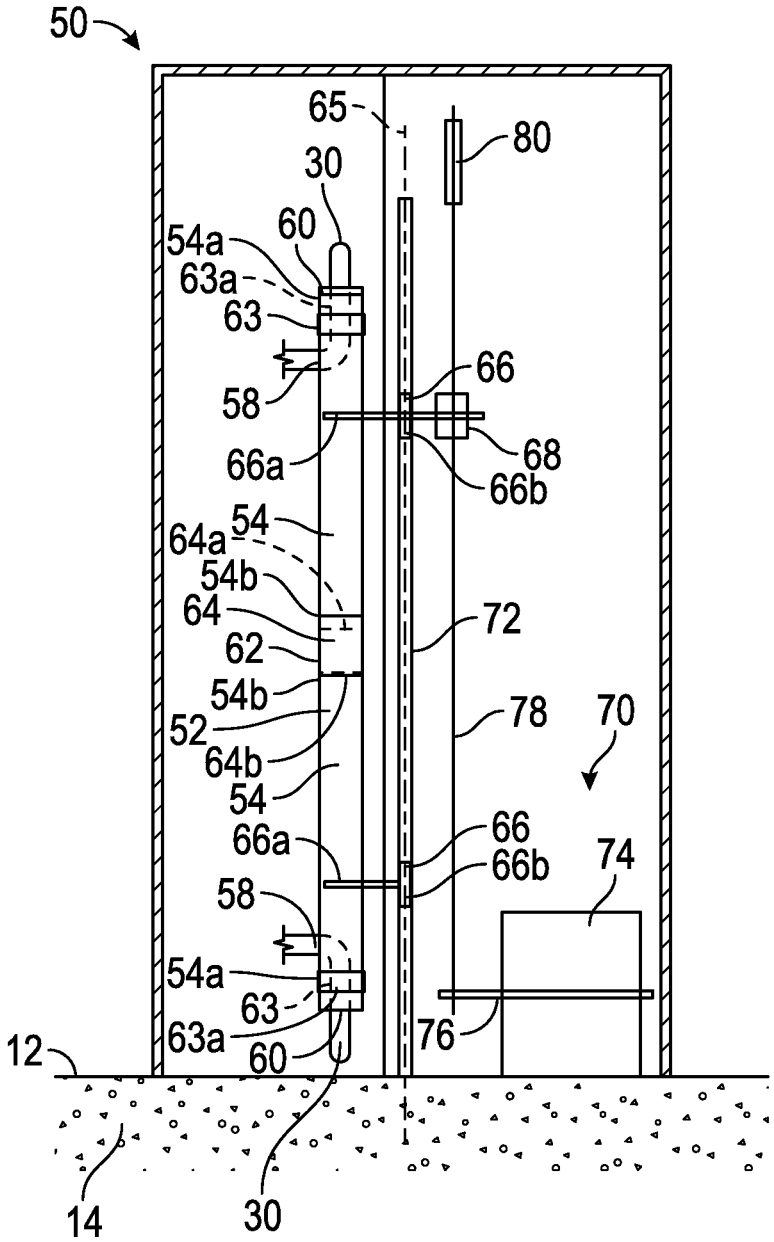
FIG. 4 is a cross-sectional rear view along line 4-4 of the buttress assembly of FIG. 3.
Figure 5:
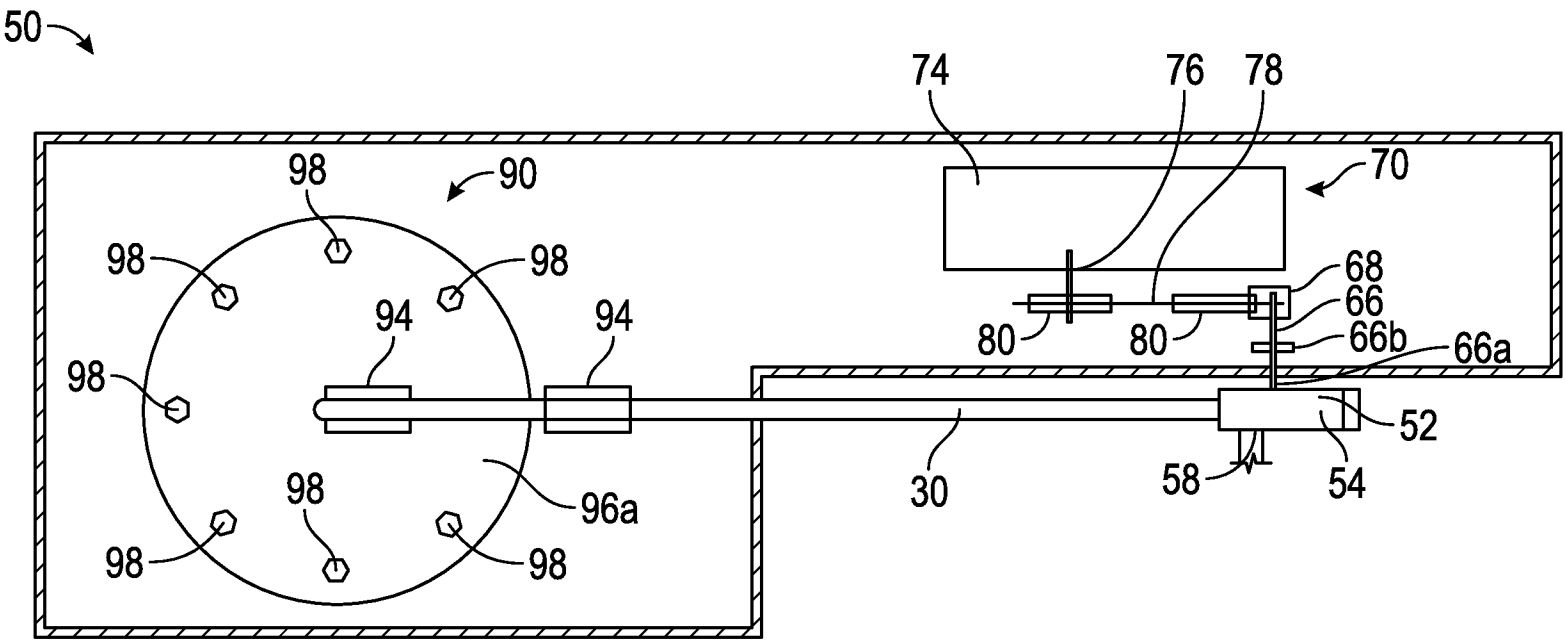
FIG. 5 is a cross-sectional top view along line 5-5 of the buttress assembly of FIG. 3.
Figure 6:
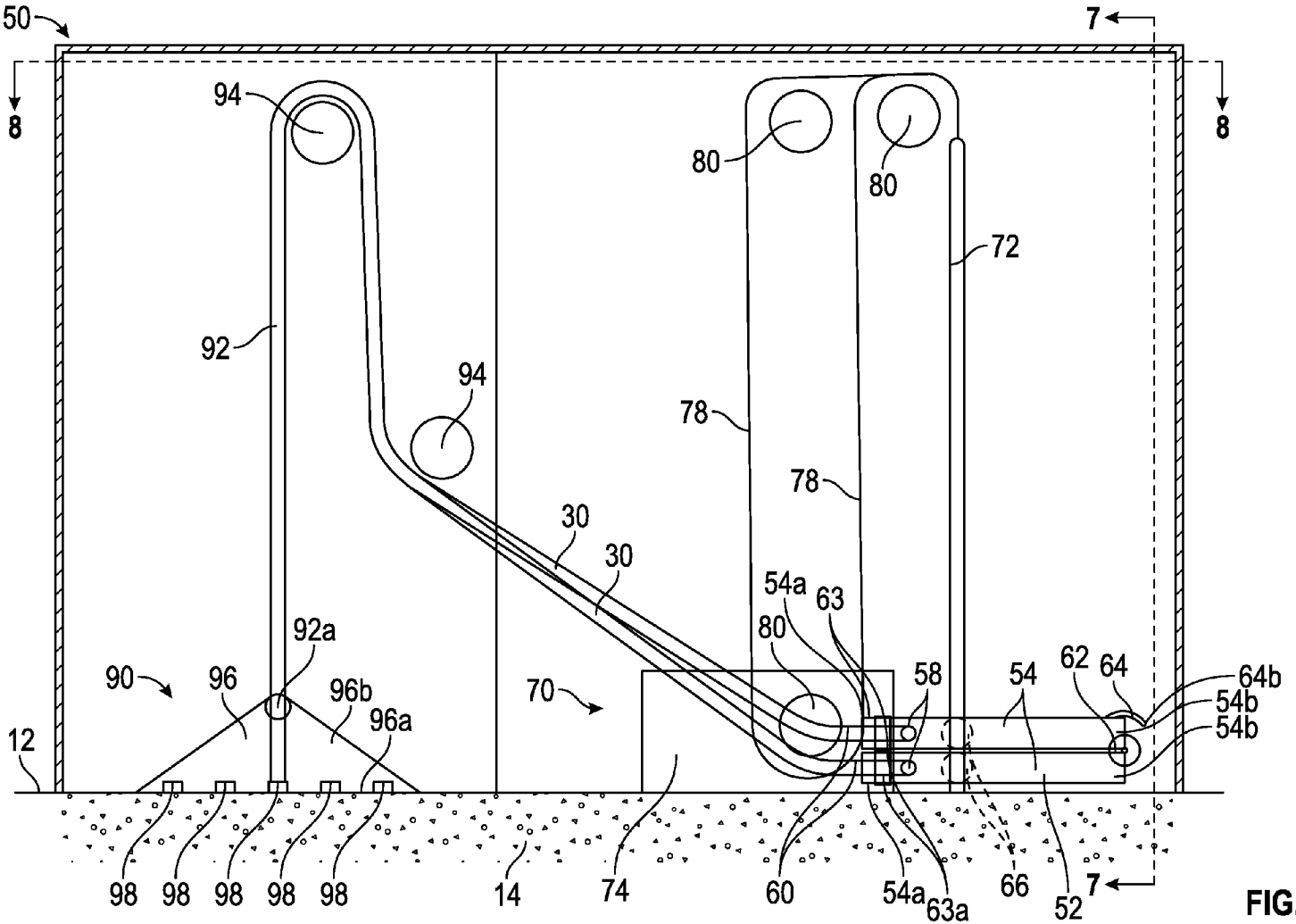
FIG. 6 is a cross-sectional side view along line 3-3 of the buttress assembly of FIG. 2, illustrating the net barrier system in the open position.
Figure 7:
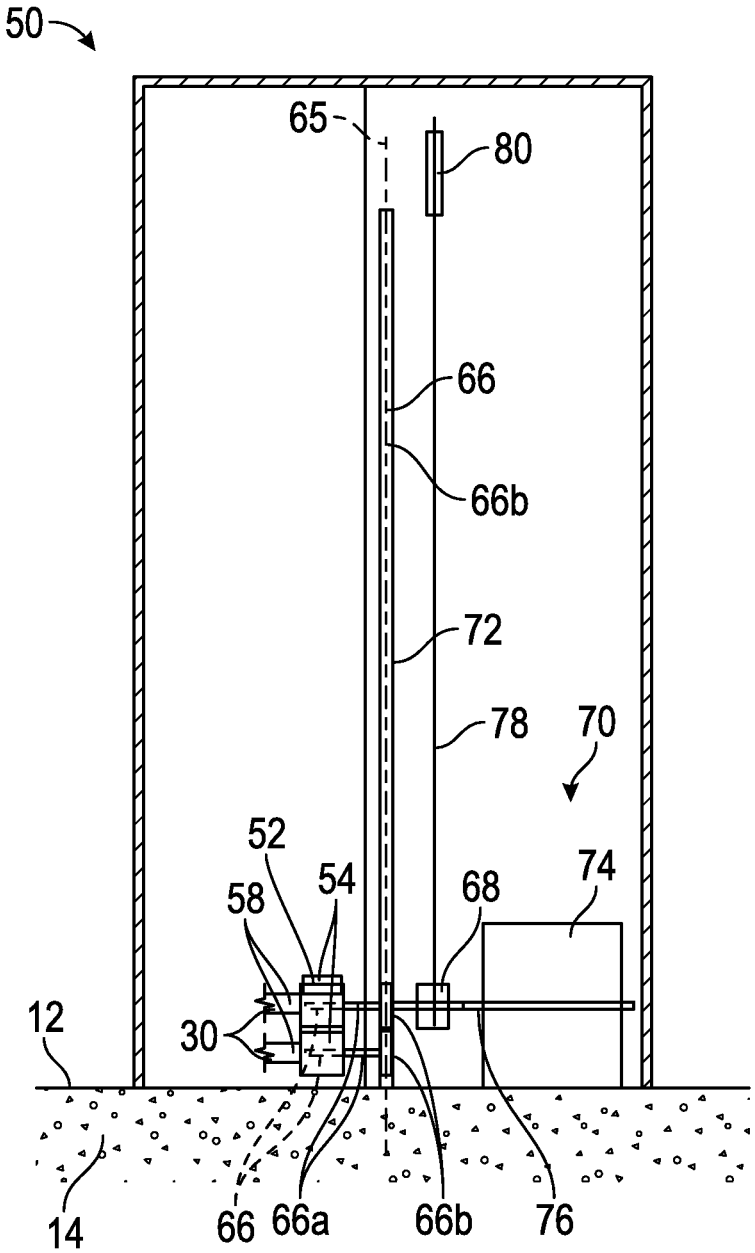
FIG. 7 is a cross-sectional rear view along line 7-7 of the buttress assembly of FIG. 6.
Figure 8:
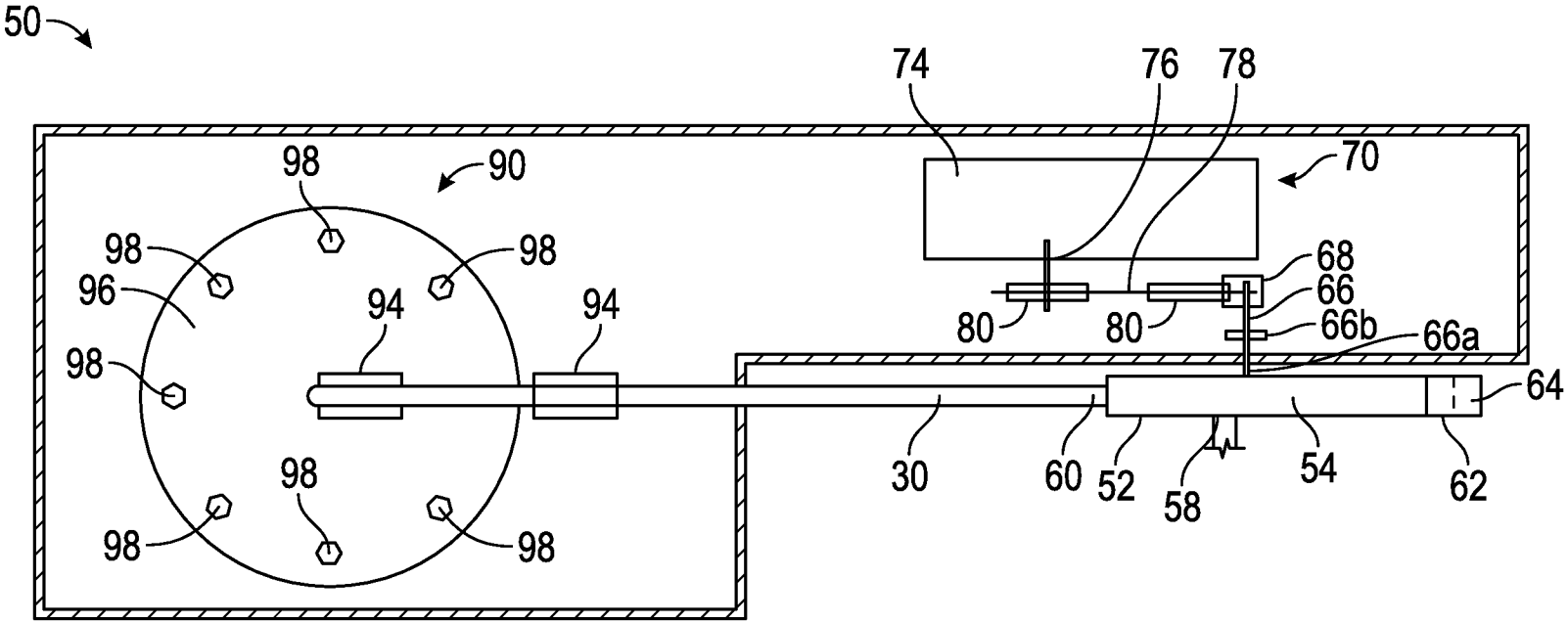
FIG. 8 is a cross-sectional top view along line 8-8 of the buttress assembly of FIG. 6.

Hinged link assembly 52 is generally configured to couple the pair of cables 30 to the actuation assembly 70, thereby allowing the cables 30 and net 20 to be actuated between the closed and open positions. Link assembly 52 generally includes a pair of link members 54 pivotably or rotatably coupled at a hinged joint 62 disposed therebetween, where each link member 54 includes a first end 54*a* distal joint 62 and a second end 54*b* proximal hinged joint 62. Hinged joint 62 is configured to allow link members 54 to rotate or pivot about joint 62, where the axis of rotation of joint 62 is disposed generally parallel with longitudinal axis 25 of net 20. A curved stop member 64 that extends arcuately about joint 62 restricts absolute rotation (i.e., 360 degree free rotation) of links 54 about joint 62, limiting an angle σ formed between links 54 to less than 90°, and thereby preventing links 54 from being disposed parallel relative a common longitudinal axis. Stop member 64 includes a first or upper end 64*a* and a second or lower end 64*b*, where upper end 64*a* physically engages upper link member 54 (as shown in FIG. 3) and lower end 64*b* physically engages lower link member 54 (as shown in FIG. 3) proximal the second end 54*b* of each link member 54 when angle σ approaches 90°. In this arrangement, the restriction of angle σ to less than 90° via stop member 64 prevents links 54 from binding during the actuation of portable net barrier 10.

Each link member 54 includes a radial opening 58 disposed proximal first end 54*a* that extends radially into the generally tubular outer surface of each link 54, and an axial opening 60 disposed at first end 54*a* of each link 54 distal hinged joint 62. Openings 58 and 60 are configured to allow for the passage of one of the cables 30 through each link member 54. Specifically, cables 30 extend between the pair of buttress assemblies 50, enter link members 54 via radial openings 58, exit link members 54 via axial openings 60 at first end 54*a*, and extend to and couple with anchoring assembly 90. Thus, the passage of cables 30 through link members 54 via openings 58 and 60 form the coupling between cables 30 and link assembly 52. Each link member 54 further includes an annular retaining member 63 disposed at the axial opening 60 at first end 54*a* and having a central bore 63*a* for the passage of cable 30. Retaining member 63 is configured to restrict relative movement between cable 30 and link member 54 (particularly relative movement along the axial length of link members 54). Particularly, retaining member 63 restricts cable 30 from being displaced through openings 58 and 60, thereby restraining the position of cable 30 with respect to link member 54. However, retaining members 63 do not permanently affix cables 30 to link assembly 52. Instead, a sufficiently strong force applied to cables 30 will allow each cable 30 to decouple from, and be displaced relative, link members 54.

For instance, when portable net barrier 10 is in the closed position and is impacted by a moving vehicle attempting to traverse between buttress assemblies 50, a reactive tension force from the collision is applied to cables 30 from net 20 sufficient to overcome the restraining force provided by the physical engagement between retaining members 63 and cables 30, thereby allowing cables 30 to be displaced through radial openings 58. Thus, retaining members 63 are configured to couple or cables 30 to link assembly 52 during normal operation, such as actuation between the closed and open positions illustrated in FIGS. 1 and 2, but upon impact between a moving vehicle and the net 20, members 63 are configured to allow cables 30 to decouple from link assembly 52, such that they may be displaced through openings 58 and 60.

Referring specifically to FIGS. 4, 5, 7, and 8, each link member 54 of link assembly 52 includes a radially extending guide member 66 disposed proximal first end 54*a* configured to moveably couple link assembly 52 with actuation assembly 70. In particular, guide members 66 are configured to guide or define the translation of link members 54 during actuation of the actuation assembly 70 such that cables 30 and net 20 remain vertical with respect to the surface 12 of the ground 14 during deployment and refraction. Thus, as portable net barrier 10 is actuated between the closed and open positions the guide member 66 of each link member 54 is continuously disposed along a common vertical axis 65. Guide members 66 include a shaft member 66*a* that extends radially into the generally tubular body of link member 54 proximal first end 54*a* and a roller 66*b* coupled to shaft member 66*a*. Link assembly 52 also includes a chain connection 68 configured to couple link assembly 52 and cables 30 to actuation assembly 70. Specifically, chain connection 68 couples link assembly 52 to a chain 78 (as will be discussed further herein) of the actuation assembly 70 such that link assembly 52 may be displaced vertically upwards (i.e., parallel with vertical axis 65) when portable net barrier 10 is deploying into the closed position from the open position, and vertically downwards when assembly 10 is retracting into the open position from the closed position. Chain connection 68 is coupled to a link member 54 proximal an axial end of a shaft member 66*a* of one of the guide members 66.

Referring again to FIGS. 3-8, actuation assembly 70 is configured to actuate the portable net barrier 10 between the closed and open positions. Specifically, actuation assembly 70 is configured to displace link assembly 52 perpendicularly (parallel with vertical axis 65) from the surface 12, such that the cables 30 and net 20 are also displaced perpendicularly from the surface 12 of the ground 14 (parallel with axis 65) when actuated between the closed and open positions. Actuation assembly 70 generally includes a guide rail 72, a motor 74, a drive shaft 76, chain 78, and a plurality of sprockets 80.

Guide rail 72 is generally configured to guide link assembly between the closed and open positions such that cables 30 and net 20 travel perpendicularly (parallel with axis 65) with respect to the surface 12. Rail 72 is coupled to rollers 66*b* of the guide member 66 of each link member 54, and during actuation between the closed and open positions, rollers 66*b* travel along the vertical guide rail 72, which extends parallel to vertical axis 65. Guide rail 72 is also configured to retain the link assembly 52 to the actuation assembly 70 when net 20 is impacted by a moving vehicle. Therefore, upon impact between net 20 and a moving vehicle, a portion of the reactive forces transferred to cables 30 by net 20 may act against link assembly 52, the reactive forces being resisted by the coupling between link assembly 52 and actuation assembly 70, where the coupling between link assembly 52 and actuation assembly 70 is effectuated by physical engagement between guide rail 72 and guide members 66.

Chain 78 of actuation assembly 70 is generally configured to convert rotational motion provided by the drive shaft 76 coupled to motor 74 to the reciprocal motion of link assembly 52 (i.e., during actuation between the closed and open positions). Chain 78 couples to link assembly 52 via chain connection 68, couples to motor 74 via drive shaft 76, and is positioned via the plurality of sprockets 80. Motor 70 is configured to provide power to drive the rotational motion of drive shaft 76, which is rotationally coupled to chain 78. In the embodiment of FIGS. 3-8, motor 74 comprises a 25 volt power supply, similar to starter motors used in passenger vehicles. Motor 74 may be powered using the battery of a passenger vehicle, a solar panel, a wall plug, and other electrical sources. However, in other embodiments motor 74 may comprise other types of motors capable of providing rotational torque, such as pneumatic motors, hydraulic motors, and human-powered hand cranks. For instance, a hand crank may be coupled to chain 78 via a sprocket 80. Such an arrangement may be advantageous in situations where other means of powering portable barrier system 10 (e.g., electrical, hydraulic power systems, etc.) are not available, such as in rural or remote locations. Moreover, in other embodiments chain 78 may be replaced with other components configured to convert the rotational motion provided by drive shaft 76 to reciprocal motion for link assembly 52.

Anchoring assembly 90 is configured to absorb energy (e.g., kinetic energy) transferred to portable barrier system 10 via an impact between net 20 and a moving vehicle, and to transmit the remaining, undissipated energy and associated reactive loads to the ground 14. For instance, because the motion of the vehicle is arrested by portable barrier system 10 upon interception, the kinetic energy of the moving vehicle just prior to impact must be absorbed by system 10 and transmitted to the ground, where it may be ultimately dissipated. Anchoring system 90 is generally configured to both absorb energy transferred from the intercepted vehicle, and to transfer any remaining, unabsorbed energy or reactive forces to the ground, thereby arresting the motion of the intercepted vehicle. Anchoring system 90 is further configured to portably or releasably anchor or affix buttress assemblies 50 of portable barrier system 10 to the ground 14, such that buttress assemblies 50 may be quickly and conveniently installed, removed, and reused at other locations. For instance, anchor system 90 is configured to anchor buttress assemblies 50 to the ground 14 without the need for cementing or otherwise permanently (i.e., non-releasably) affixing buttress assemblies to the ground 14.

Anchoring assembly 90 generally includes energy absorption members 92, rollers 94, an anchor member 96, and a plurality of bolts or fasteners 98. Energy absorption members 92 are coupled to the axial ends of cables 30 and extend to and couple with anchor member 96 at connection point 92*a*. Energy absorption members 92 are configured to absorb energy (e.g., kinetic energy) transferred to them via net 20 and cables 30 in a manner such that the amount of energy and reactive loads transferred to anchor member 96 from absorption members 92 has been substantially reduced from the amount of energy and reactive loads transferred to absorption members 92 from cables 30. In this embodiment, energy absorption members 92 comprise bungee cords that deform elastically upon the application of a tension force, such as the tension force produced by cables 30 on members 92 caused by the impact between a moving vehicle and net 20. For instance, in this embodiment once a tension load is applied to members 92 from cables 30, energy is expended or dissipated by stretching or lengthening the elastic energy absorption members 92, thereby converting the transmitted kinetic energy into elastic potential energy. The potential energy stored within absorption members 92 following a collision may then be gradually released when barrier system 10 is reset. Due to the elasticity of members 92, the moving vehicle may be decelerated or arrested at a gradual rate, in a manner such that damage to the vehicle and injury to its occupants may be minimized, if not eliminated. Further, the use of bungee cords allows for the portable barrier system 10 to be quickly reset into the closed position (shown in FIG. 1) following an interception of a moving vehicle.

Energy absorption members 92 are allowed to stretch via the decoupling of cables 30 from link assembly 52, particularly, via the decoupling of retaining members 63 from link members 54, as discussed above. For instance, upon impact between a moving vehicle and net 20, cables 30 act against link assembly 52 with sufficient force to decouple from assembly 52 and then transfer reactive loads from the impact to energy absorption members 92, thereby causing members 92 to stretch, converting kinetic energy of the moving vehicle into potential energy stored within the stretched energy absorption members 92. Rollers 94 are configured to guide and position energy absorption members 92 during operation. Although in this embodiment energy absorption members 92 are described as being bungee cords, in other embodiments energy absorption members 92 may take different forms, such as hydraulic or pneumatic cylinders capable of absorbing kinetic energy, as well as other types of energy absorption devices known in the art and configured for storing and dissipating kinetic energy.

Anchor member 96 is configured to transfer loads applied to it from energy absorption members 92 to the ground 14, thus securing the buttress assemblies 50 into position even against high loads are applied to assemblies 50 via an impact between a moving vehicle and net 20. Anchor member 96 is also configured to portably or releasably couple to the ground 14 such that buttress assembly 50 may be temporarily installed at a first location, operated to selectably restrict vehicular access, and then uninstalled, transported, and installed and operated at a second location. In this embodiment, anchor member 96 includes a circular steel plate 96*a* coupled to a triangular steel gusset 96*b*, with steel gusset 96*b* attached to energy absorption members 92 at attachment point 92*a*. The circular plate 96*a* of anchor member 96 is portably or releasably coupled to the ground 14 via a plurality of circumferentially spaced bolts that extend through circular plate 96*a* of anchor member 96 into the ground 14. Thus, energy and reactive loads applied to anchor member 96 are transferred to the ground 14 via the plurality of circumferentially spaced bolts 98 in engagement with the ground 14. While in this embodiment anchor 96 is described as being secured to the ground 14 using a plurality of bolts 98, in other embodiments anchor 96 may be secured to the ground 14 using other mechanisms known in the art, such as steel rods, rivets, nelson studs, coupling to existing site features, attaching to concrete knee walls, attaching to jersey barriers and the like.

A method of operating the portable barrier system 10, including actuating portable barrier system 10 between the closed position shown in FIGS. 1 and 3-5, and the open position shown in FIGS. 2 and 6-8, generally includes transporting system 10 to a preferred controlled access point, anchoring the buttress assemblies 50 to the ground 14 via bolting anchor members 96 to the ground 14 using bolts 98, and then actuating motor 74 to retract cables 30 and net 20 by displacing link assembly 52 vertically downward, perpendicular to the surface 12 of the ground 14 (parallel with vertical axis 65). In this method, the motor 74 may be actuated via a push-button console coupled to the motor 74, remotely using a wireless connection, or through other mechanisms for actuating electronic devices that are known in the art. Further, in other embodiments, instead of actuating motor 74 a hand crank powered by an operator of system 10 may otherwise be used.

Figure 9:
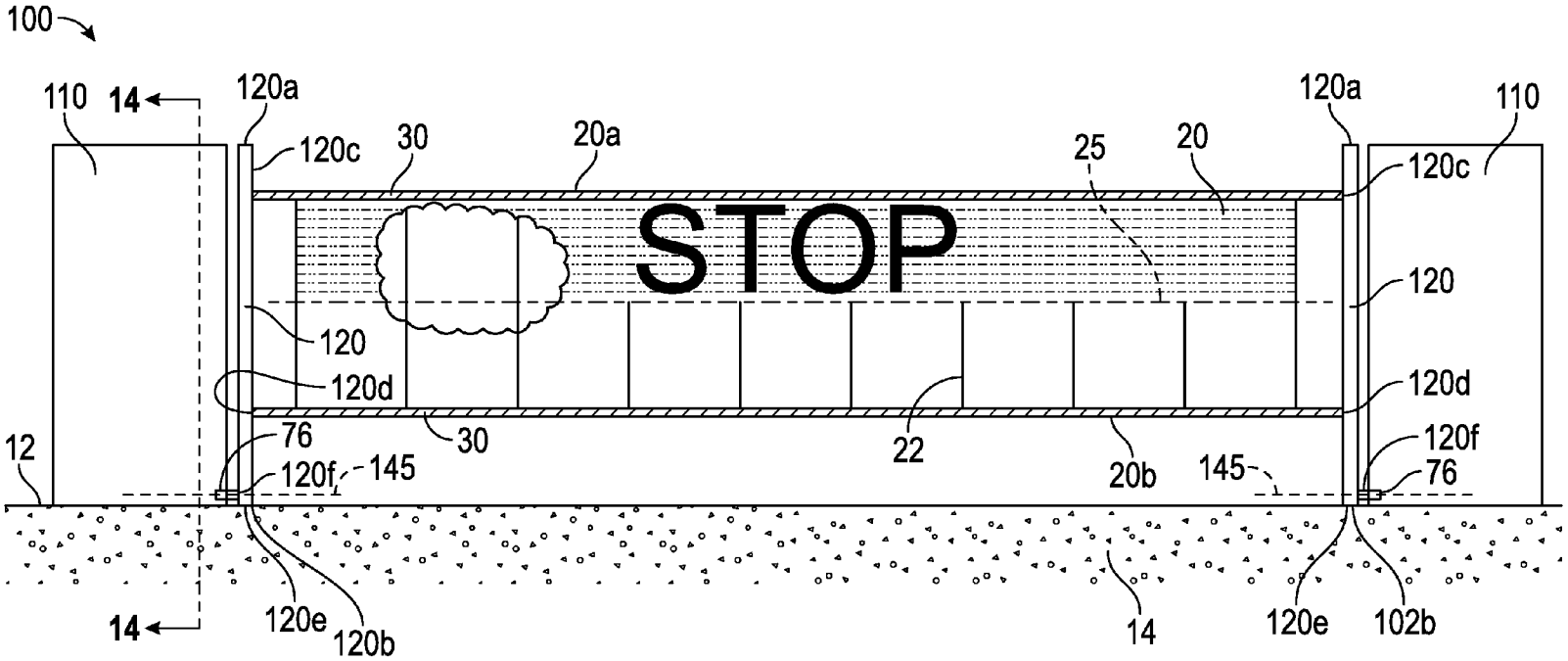
FIG. 9 is a front view of another embodiment of a net barrier system, illustrated in a closed position, in accordance with principles disclosed herein.

Referring to FIG. 9, another embodiment of a net barrier system 100 is shown in a closed position restricting vehicle access therethrough. Net barrier system 100 shares some similar features with net barrier system 10, and features shared between systems 100 and 10 are similarly labeled. As with net barrier system 10, net barrier system 100 may comprise a portable net barrier system. For instance, net barrier system 100 can be configured to be quickly and conveniently installed, removed, and reused at other locations. Also like net barrier system 10, net barrier system 100 is configured to decelerate or arrest an intercepted vehicle at a gradual rate, in a manner such that damage to the vehicle and injury to its occupants may be minimized, if not eliminated. Net barrier system 100 generally includes net 20, horizontally extending cables 30, and a pair of buttress assemblies 110 coupled or affixed to the surface 12 of the ground 14. As with net barrier system 10, net 20 of net barrier system 100 is configured to intercept a moving vehicle attempting to travel between the pair of buttress assemblies 110 by transferring an arresting force to the vehicle to thereby decelerate the vehicle, and cables 30 are configured to survive an interception of a moving vehicle.

Figure 10:
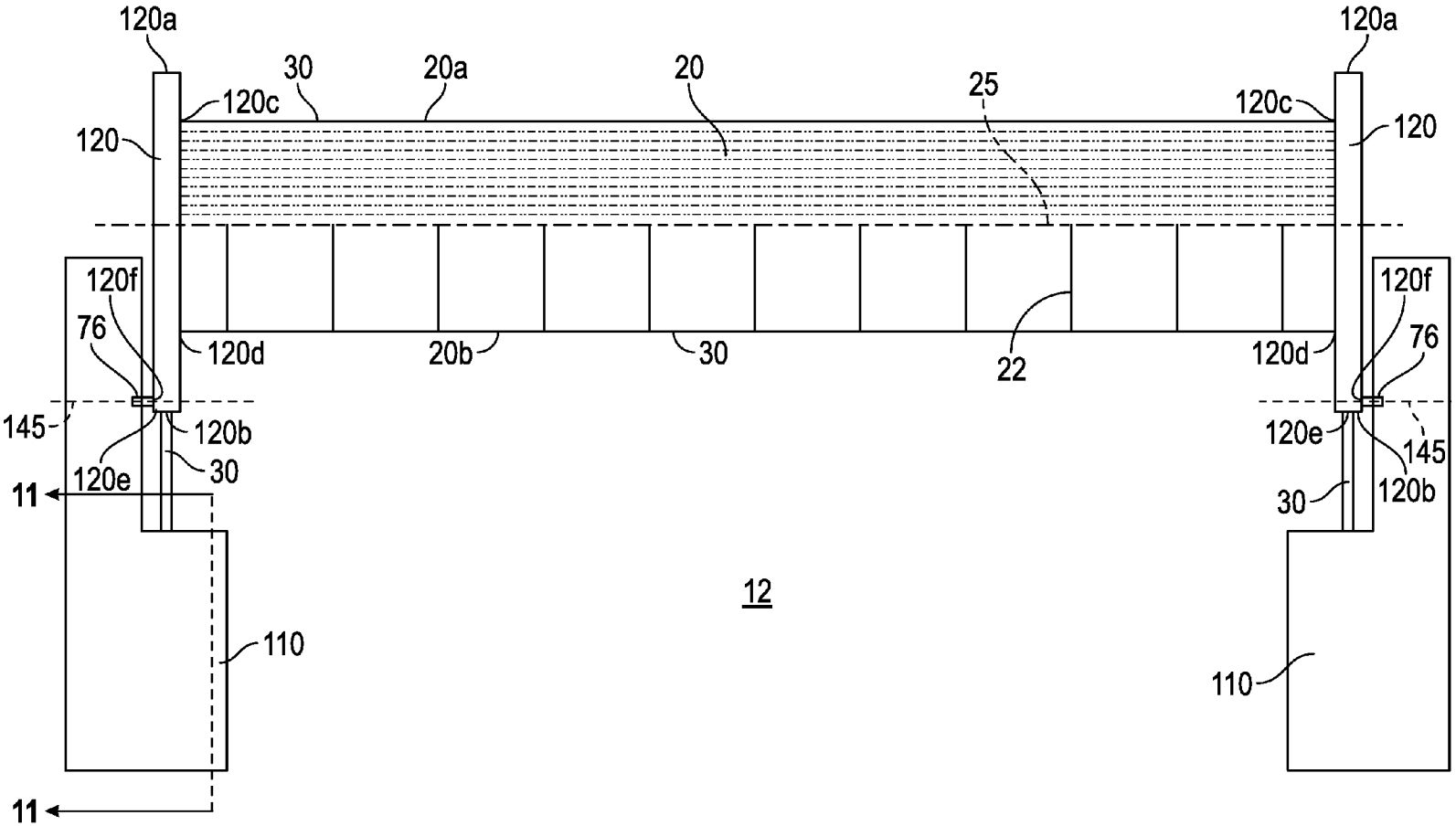
FIG. 10 is a front view of the net barrier system of FIG. 9, illustrated in an open position, in accordance with principles disclosed herein.
Figure 11:
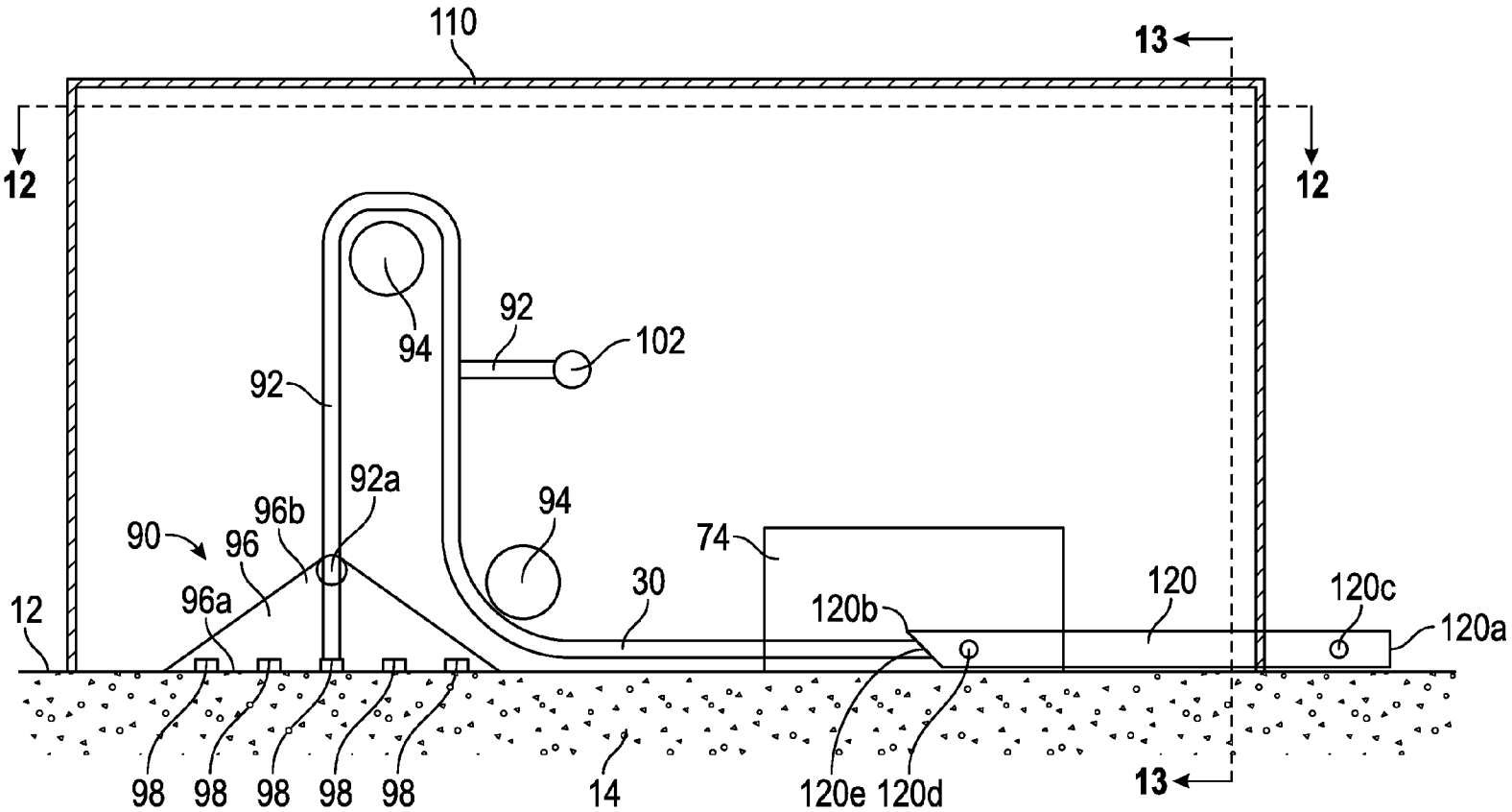
FIG. 11 is a cross-sectional side view along line 11-11 of a buttress assembly of the net barrier system of FIG. 10, illustrated in a closed position, in accordance with principles disclosed herein.
Figure 12:
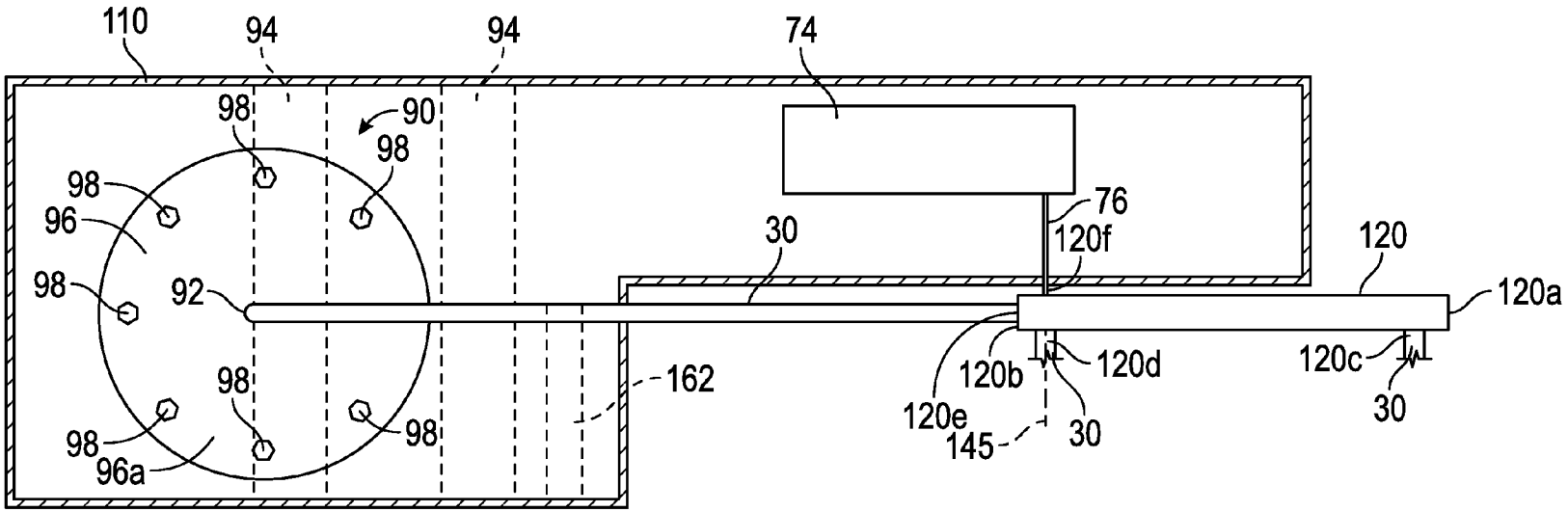
FIG. 12 is a cross-sectional rear view along line 12-12 of the buttress assembly of FIG. 11.
Figure 13:
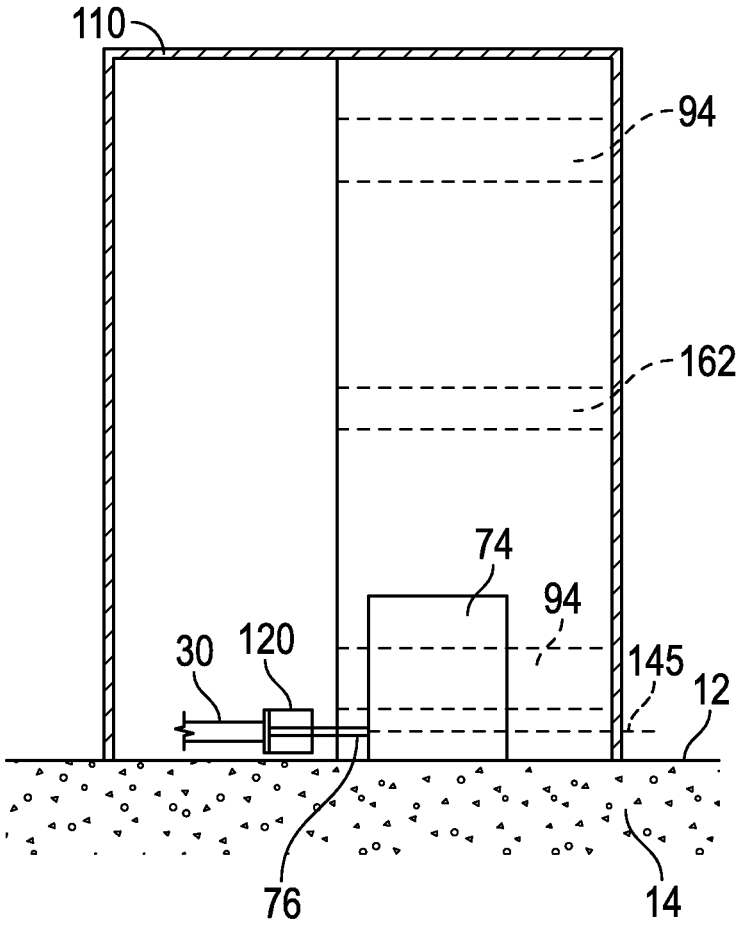
FIG. 13 is a cross-sectional top view along line 13-13 of the buttress assembly of FIG. 11.
Figure 14:
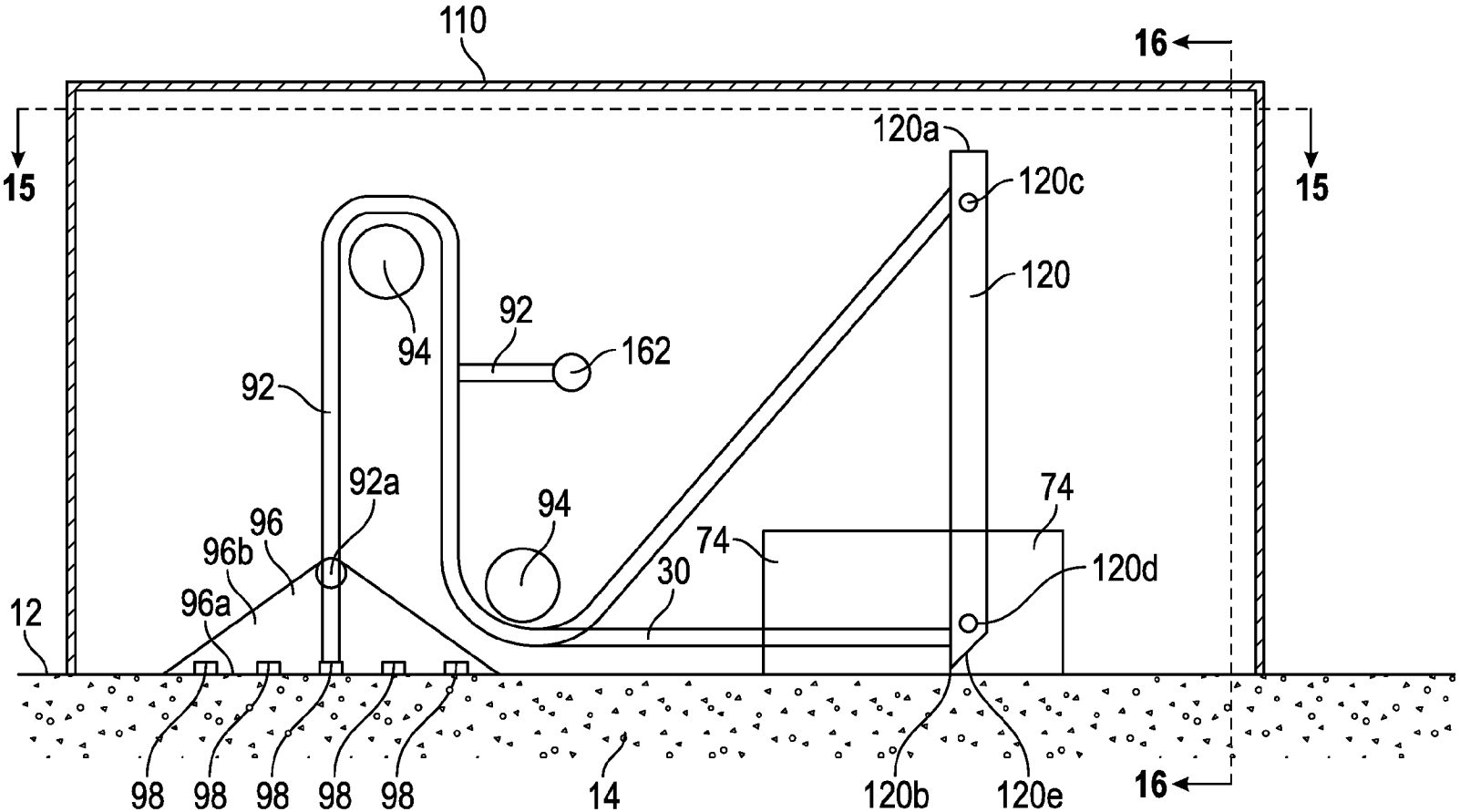
FIG. 14 is a cross-sectional side view along line 14-14 of the buttress assembly of FIG. 9, illustrating the net barrier system in the open position.
Figure 15:
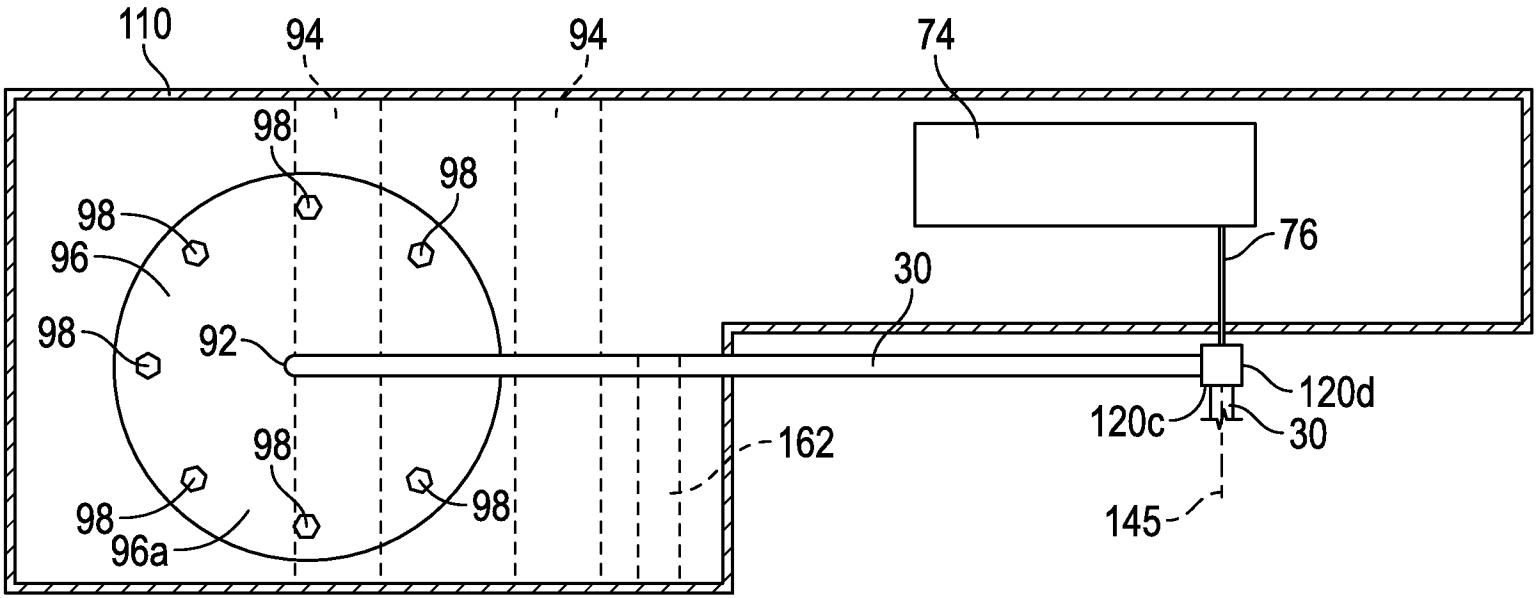
FIG. 15 is a cross-sectional rear view along line 15-15 of the buttress assembly of FIG. 14.
Figure 16:
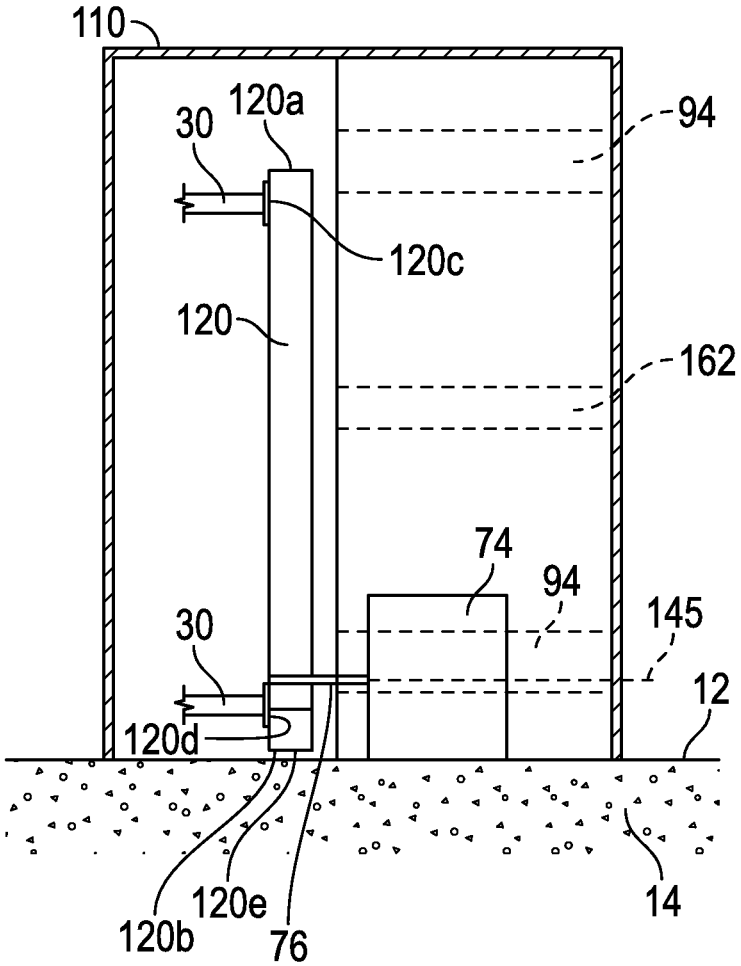
FIG. 16 is a cross-sectional top view along line 16-16 of the buttress assembly of FIG. 14.

Referring to FIG. 10, portable net barrier system 100 is shown in an open position allowing vehicular access between the pair of buttress assemblies 110. In the open position, net 20 flat against the surface 12 of the ground 14, unfolded along longitudinal axis 25 in contrast to the open position of net barrier system 10 shown in FIG. 2. In the embodiment of FIGS. 9 and 10, instead of being displaced perpendicularly relative the surface 12 when net barrier system 100 transitions from the closed position to the open position, net 20 and cables 30 are rotated about an axis of rotation, as will be explained further herein.

Referring to FIGS. 9-16, each buttress assembly 110 generally includes a generally tubular post member 120, an actuation assembly 140, and an anchoring assembly 160. Buttress assembly 110 is configured to provide for the actuation of the portable barrier system 100 between the closed and open positions shown in FIGS. 9 and 10, respectively. Specifically, buttress assembly 110 is configured to rotate cables 30 and net 20 between the closed position shown in FIG. 9 and the open position shown in FIG. 10. Moreover, buttress assembly 100 is configured to transfer the energy and force transmitted to the net 20 from the decelerating vehicle to the ground 14 via cables 30 and anchoring assembly 160.

The post 120 of each buttress assembly 110 includes a first or upper end 120*a* and a second or lower end 120*b* and is coupled to a terminal longitudinal end of net 20, as shown in FIGS. 9 and 10. In the closed position of net barrier system 100 shown in FIG. 9, lower end 120*b* of each post member 120 is disposed proximal, or engages, the surface 12 of the ground 14 while upper 120*a* is displaced perpendicularly from the surface 12. Each post member 120 includes a first or upper radial aperture 120*c* proximal upper end 120*a* and a second or lower radial aperture 120*d* distal upper end 120*a*. Upper radial aperture 120*c* allows for the passage of the cable 30 disposed along upper edge 20*a* of net 20 through post 120 while lower radial aperture 120*d* allows for the passage of the cable 30 disposed along lower edge 20*b* of net 20 through post 120. Each post 120 also includes an axial aperture 120*e* disposed at lower end 120*b*. In this arrangement, cables 30 may extend through post 120 via upper and lower radial apertures 120*c*, 120*d*, and axial aperture 120*e*. In the event of a collision between net 20 and a moving vehicle, net 20 detaches from posts 120 and cables 30 are displaced through axial apertures 120*e* and upper and lower radial apertures 120*c* and 120*d*. Each post 120 may include a restraining member to prevent inadvertent displacement of cables 30 through apertures 120*e*, 120*c*, and 120*d*, prior to a collision between net 20 and a moving vehicle.

Each post 120 further includes a drive connection 120*f* which receives a terminal end of drive shaft 76 extending from the motor 74 of actuation assembly 140. In this embodiment, actuation assembly 140 is configured to rotate posts 120 and net 20 about an axis of rotation 145 coaxially aligned with the drive shaft 76 of each motor 74. Particularly, actuation assembly 140 is configured to rotate posts 120 and net 20 between the closed position of net barrier assembly 100 shown in FIG. 9 and the open position of net barrier system 100 shown in FIG. 10. Rotation of posts 120 and net 20 about the axis of rotation 145 is accomplished via the torque provided by each motor 74 to drive shaft 76, which couples to posts 120 at drive connection 120*f*. Unlike net barrier system 10, in the embodiment of net barrier system 100, sprockets and chains are not incorporated in actuation assembly 140, and instead, there is a direct drive connection between motor 74 and post 120 via drive shaft 76.

Anchoring assembly 160 of net barrier system 100 is configured to absorb energy (e.g., kinetic energy) transferred to barrier system 100 via an impact between net 20 and a moving vehicle, and to transmit the remaining, undissipated energy and associated reactive loads to the ground 14. For instance, because the motion of the vehicle is arrested by portable barrier system 10 upon interception, the kinetic energy of the moving vehicle just prior to impact must be absorbed by system 10 and transmitted to the ground, where it may be ultimately dissipated. Anchoring system 160 is further configured to portably or releasably anchor or affix buttress assemblies 110 of portable barrier system 100 to the ground 14, such that buttress assemblies 110 may be quickly and conveniently installed, removed, and reused at other locations.

Each anchoring assembly 160 generally includes energy absorption members 92, rollers 94, anchor member 96, a plurality of bolts or fasteners 98. Similar to net barrier system 10, the energy absorption members 92 of net barrier system 100 absorption members 92 are coupled to the axial ends of cables 30 and extend to and couple with anchor member 96 at connection point 92*a*. Energy absorption members 92 are configured to absorb energy (e.g., kinetic energy) transferred to them via net 20 and cables 30 in a manner such that the amount of energy and reactive loads transferred to anchor member 96 from absorption members 92 has been substantially reduced from the amount of energy and reactive loads transferred to absorption members 92 from cables 30. The anchoring assembly 160 of net barrier system 100 also includes a support bar 162 coupled to a terminal end of one of the energy absorption members 92 to provide additional support and absorption of kinetic energy received from the intercepted vehicle.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A barrier system comprising:

an elastic net having a cable coupled thereto;

an energy absorption member coupled between the cable and an anchoring assembly;

a post having a longitudinal axis, wherein the post is coupled to a longitudinal end of the net; and an actuation assembly coupled to the net and configured to rotate the net about an axis of rotation between a closed position restricting vehicle access through the barrier system, and an open position allowing vehicle access through the barrier system;

wherein the actuation assembly comprises:

a drive shaft coupled to the post and configured to rotate the post and net about the axis of rotation; and a motor coupled to the drive shaft and configured to rotate the drive shaft about the axis of rotation:

wherein, when the actuation assembly rotates the net between the closed and open positions, the net remains unfolded;

wherein the cable is configured to transfer a kinetic energy of a moving vehicle impacting the net to the energy absorption member;

wherein the energy absorption member is configured to absorb at least a portion of the kinetic energy;

wherein the cable extends through a passage extending longitudinally through the post.

2. The barrier system of claim 1, wherein the anchoring assembly is configured to releasably affix the barrier system to the ground.

3. The barrier system of claim 1, wherein the energy absorption member comprises an elastic cord covered with a sheath.

4. The barrier system of claim 1, wherein the post is configured to displace the net between the closed position restricting vehicle access through the barrier system, and the open position allowing vehicle access through the barrier system.

5. The barrier system of claim 1, wherein, in response to the rotation of the post about the axis of rotation, the net is displaced between the open and closed positions.

6. The barrier system of claim 1, wherein the anchoring assembly comprises a plate releasably coupled to the ground via a plurality of bolts.

7. The barrier system of claim 1, wherein the drive shaft is disposed coaxially with the axis of rotation.

8. A barrier system comprising:

an elastic net coupled to a cable;

an energy absorption member coupled between the cable and an anchoring assembly;

a post having a longitudinal axis, wherein the post is coupled to a longitudinal end of the net; and an actuation assembly coupled to the net and configured to rotate the net about an axis of rotation between a closed position restricting vehicle access through the barrier system, and an open position allowing vehicle access through the barrier system;

wherein the actuation assembly comprises:

a drive shaft coupled to the post and configured to rotate the post and net about the axis of rotation; and a motor coupled to the drive shaft and configured to rotate the drive shaft about the axis of rotation:

wherein, when the actuation assembly rotates the net between the closed and open positions, the net remains unfolded;

wherein the cable extends through a passage extending longitudinally through the post;

wherein both the energy absorption member and the elastic net are configured to absorb kinetic energy transmitted from a moving vehicle impacting the net.

9. The barrier system of claim 8, wherein the anchoring assembly is configured to releasably affix the barrier system to the ground.

10. The barrier system of claim 8, wherein the energy absorption member comprises an elastic cord covered with a sheath.

11. The barrier system of claim 8, wherein each longitudinal end of the net is coupled to a post configured to be rotated about the axis of rotation in response to the actuation assembly actuating the barrier system between the closed and open positions.

12. The barrier system of claim 11, wherein the drive shaft is disposed coaxially with the axis of rotation.

13. The barrier system of claim 11, wherein the motor of the actuation assembly is configured to drive a sprocket.

14. The barrier system of claim 8, wherein the anchoring assembly comprises a plate releasably coupled to the ground via a plurality of bolts.

15. A barrier system comprising:

an elastic net coupled to a cable;

an energy absorption member coupled between the cable and an anchoring assembly;

a post having a longitudinal axis, wherein the post is coupled to a longitudinal end of the net; and an actuation assembly coupled to the net and configured to rotate the net about an axis of rotation between a closed position restricting vehicle access through the barrier system, and an open position allowing vehicle access through the barrier system;

wherein the actuation assembly comprises:

a drive shaft coupled to the post and configured to rotate the post and net about the axis of rotation; and a motor coupled to the drive shaft and configured to rotate the drive shaft about the axis of rotation;

wherein the cable extends through a passage extending longitudinally through the post;

wherein, when the actuation assembly rotates the net between the closed and open positions, the net remains unfolded.

16. The barrier system of claim 15, wherein the anchoring assembly is configured to releasably affix the portable barrier system to the ground.

17. The barrier system of claim 15, wherein each longitudinal end of the net is coupled to a post configured to be rotated about the axis of rotation in response to the actuation assembly actuating the barrier system between the closed and open positions.

18. The barrier system of claim 15, wherein the drive shaft is disposed coaxially with the axis of rotation.

* * * * *